US005325598A

United States Patent [19]

Hall et al.

[11] Patent Number: 5,325,598

[45] Date of Patent: Jul. 5, 1994

[54] VARIABLE APERTURE PEEP SIGHT FOR BOWS

[76] Inventors: David D. Hall, 4926 NW. 29th Pl., Gainesville, Fla. 32606-6008; Garret Hull, 18015 Butternut Rd., Lynnwood, Wash. 48037

[21] Appl. No.: 877,049

[22] Filed: Apr. 30, 1992

[51] Int. Cl.[5] ..... F41G 1/467

[52] U.S. Cl. ..... 33/265; 33/251; 124/87

[58] Field of Search ..... 33/265, 251; 124/87

[56] References Cited

U.S. PATENT DOCUMENTS

| | | | |
|---|---|---|---|
| 873,112 | 12/1907 | Windridge et al. | 33/251 |
| 2,167,012 | 7/1939 | Tetzlaff | 33/244 |
| 3,703,770 | 11/1972 | Sofield | 33/265 |
| 3,703,771 | 11/1972 | Saunders | 33/265 |
| 3,859,733 | 1/1975 | Chesnick | 33/265 |
| 3,930,316 | 1/1976 | Tellie | 33/251 |
| 4,011,853 | 3/1977 | Fletcher | 33/265 |
| 4,116,194 | 9/1978 | Topel | 124/87 |
| 4,454,857 | 6/1984 | Miller | 124/87 |
| 4,563,821 | 1/1986 | Saunders | 33/265 |
| 4,625,422 | 12/1986 | Carlson | 33/265 |
| 4,656,746 | 4/1987 | Gillespie | 33/265 |
| 4,656,747 | 4/1987 | Troncoso | 33/265 |
| 4,833,786 | 5/1989 | Shores | 33/265 |
| 4,860,458 | 8/1989 | Ernstsen et al. | 124/90 |
| 4,895,129 | 1/1990 | Hedgpeth | 33/265 |
| 4,934,332 | 6/1990 | Scherz | 124/90 |
| 4,961,264 | 10/1990 | Topel | 33/265 |
| 4,965,938 | 10/1990 | Saunders | 124/87 |
| 5,080,084 | 1/1992 | Kendall et al. | 124/87 |

FOREIGN PATENT DOCUMENTS

| | | | |
|---|---|---|---|
| 104408 | 7/1938 | Australia | 33/251 |

*Primary Examiner*—Thomas B. Will

*Attorney, Agent, or Firm*—Stephen M. Evans; David L. Garrison

[57] ABSTRACT

A bowstring mounted peep sight is disclosed having a peep housing that is frictionally located between displaced bowstring filaments. The peep housing defines a peep hole and a transverse oriented receiving slot. Insertable aperture reducing discs are slidably inserted into the receiving slot to incrementally decrease the relative aperture of the peep hole. To prevent the inserts from being inadvertently dislodged from the receiving slot during use of the invention, one of the displaced bowstring elements is positioned so as to prevent the disc from sliding outwardly therefrom. Because of the design of the peep housing, lightweight materials can be utilized. Frusto conical recesses on both planar surfaces of the peep housing reduce incidental glare thereby increasing the clarity of the observed target.

6 Claims, 2 Drawing Sheets

VARIABLE APERTURE PEEP SIGHT FOR BOWS

BACKGROUND OF THE INVENTION

1. Field of the Invention

The present invention relates generally to an aiming sight and more specifically to a bowstring peep sight for use in the sport of archery.

2. Prior Art

Many inventions, patented and unpatented, have been directed to the art of aiming aids for the sport of archery. One of the more predominant forms of aiming aids has been the "string peep." Generally, the string peep or peep sight is an aiming aid that has an opaque surface and an aiming hole, and is positioned substantially along the string of a bow—often times the peep sight is integral with the bowstring. As the bowstring is pulled back in anticipation of releasing an arrow, the archer sights the target by viewing it through the peep sight. A bow mounted front sight may aid in targeting the object.

A nocking point is provided in many bowstrings for locating the receiving portion of an arrow shaft. In this manner, an arrow can be consistently released from the same relative point along the bowstring. Similarly, a peep sight mounted to the bowstring may be located by means of a knot, anchor, or the like. While this method of attachment prevents movement and hence inaccuracies relating to the aiming of the arrows, it also makes moving or removing the peep sight from the bow exceedingly difficult. As to the difficulty in moving the peep sight, previous inventions have used stationary peep housing with vertically sliding sights. More recent inventions have used displaced bowstring filaments to frictionally fit the sight therebetween. As to removing the peep sight, certain previous inventions required that the sight be disassembled or the bowstring removed while inventions required the removal of anchoring aids prior to the removal of the peep sight.

It should be noted where a peep sight is easily removable, there is an increased likelihood that a peep sight will be thrown from its mounting location. Therefore, a peep sight should be securely mounted to the bowstring yet be readily removable. This factor is especially desirable when using a compound bow, as it is well known that the velocity in which an arrow leaves a compound bow is greater than that of a long bow or recurve bow. Hence, a peep sight used in a compound bow is especially susceptible to being dislodged when the bowstring is released from its drawn position.

It is also well known in the prior art that a small diameter peep hole increases the accuracy of the peep sight. However, small diameter peep holes decrease the observed illumination of the target. Therefore, in low light situations, an archer must use a larger diameter peep hole in order to adequately spot the target, and consequentially must sacrifice accuracy. In an indoor setting, the available light is usually constant and the need is minimal to replace a peep sight of a given aperture. But in the field, varying light conditions are often encountered. Consequently, it is likely that an archer would wish to optimize the peep sight's accuracy for any given light condition. Traditionally, changing the diameter of the peep hole meant that an archer had to physically remove the peep sight and install another sight having a hole of greater aperture. While some newer peep sights have attempted to remedy this problem, the proposed solutions have been cumbersome and heavy—a condition that could significantly decrease the accuracy and velocity in which an arrow leaves the bow.

SUMMARY OF THE INVENTION

It is therefore an object of the present invention to provide a peep sight which permits easy adjustment along the bowstring and easy installation and removal of the sight. However, the means for mounting must also prevent the accidental dislodgment of sight when a drawn bow is released.

It is also an object of the invention to provide a peep sight that utilizes a means for varying the aperture of the peep hole wherein an archer can compensate for changing light conditions while maintaining optimum accuracy.

It is yet another object of the invention to provide for a variable aperture peep sight wherein the means for varying the aperture of the peep hole is quick and convenient.

It is a further object of the invention to provide a peep sight meeting the above described objects while being light in weight, durable, and easy to manufacture.

The present invention comprises a peep housing defining a fixed diameter peep hole and a disc receiving slot. To provide a means for mounting the invention to a bow, the peep housing further comprises at least two bowstring filament receiving channels or notches. By segmenting a bowstring's filament and engaging each segment with one notch, the peep sight is frictionally held in contact with the bowstring. One or more aperture reducing discs, formed to fit within the receiving slot, have a peep hole axially located therein to cause the aperture of the peep hole to vary when the discs are inserted into the receiving slot.

In a preferred embodiment, the housing has on opposing planar surfaces frusto conical recesses whose apexes are connected by the peep hole. In this manner, incidental glare is minimized while retaining sharpness of the viewed target for improved accuracy. A preferred embodiment also provides for one of the bowstring filaments to retain the aperture reducing disc once inserted into the receiving slot when the invention is in use.

All of the above objects, features, and provisions are carried out using a light weight housing that uses the inherent structural strength of a curve to withstand the compressive forces created from the displaced filaments of the bowstring.

BRIEF DESCRIPTION OF THE DRAWINGS

In the several views, like numerals indicate like parts unless otherwise indicated and.

DETAILED DESCRIPTION OF A PREFERRED EMBODIMENT

Figure 1:
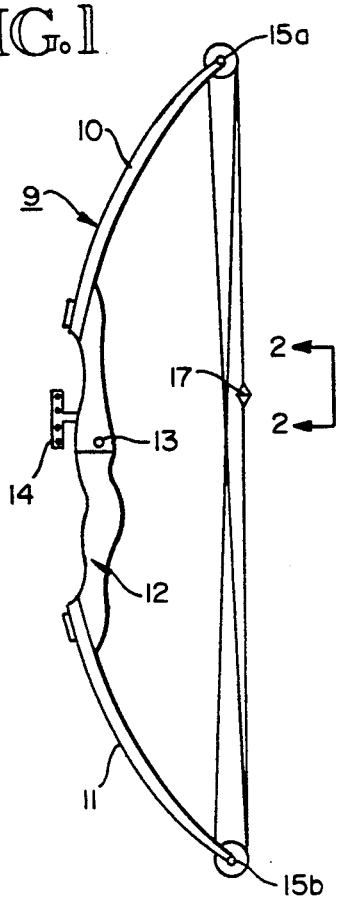
FIG. 1 is a side elevation view of a relaxed bow having a peep sight mounted internal to displaced bowstring filaments.
Figure 1A:
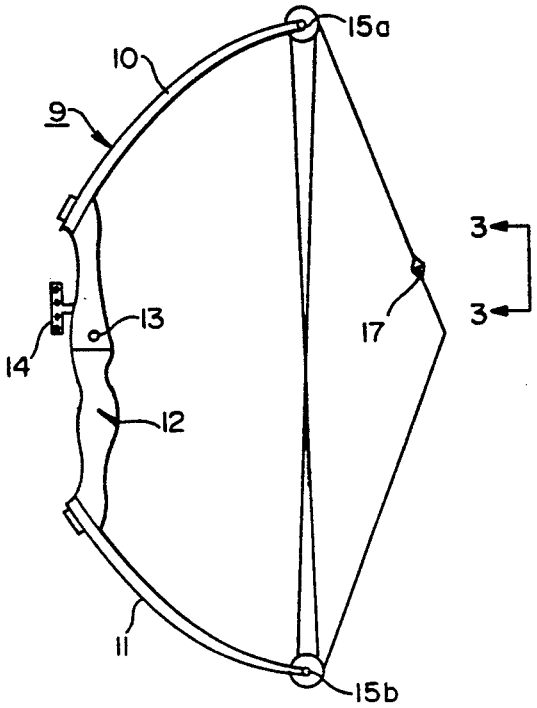
FIG. 1*a* is similar to FIG. 1 except that the bow is shown in a drawn position.

Referring first to FIG. 1, bow 9 is shown having upper limb 10 and lower limb 11, riser section 12, arrow rest 13, front sight 14, cam pulley 15*a* and 15*b*, and bowstring 16. Bow 9 is shown in its relaxed state and its drawn state in FIG. 1*a*.

Figure 3:
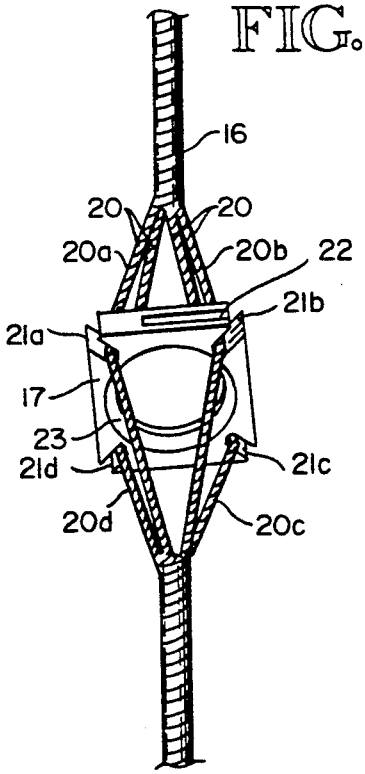
FIG. 3 is an enlarged perspective view taken substantially along the line 3—3 of FIG. 1*a* showing in more detail the displacement of the bowstring filaments and one frusto conical section of the invention.

FIG. 3 more adequately shows the external characteristics of peep housing 17. Peep housing 17 is preferably supported by four bowstring filaments 20*a*, 20*b*, 20*c*, and 20*d* (collectively or generically referred to as bowstring filaments 20) which have been displaced from bowstring 16. To hold peep housing 17 therebetween notches 21*a*, 21*b*, 21*c*, and 21*d* are provided at the corners of the peep housing 17. By grouping bowstring filaments 20 such that each filament 20 has an equal or near equal number of filaments, the compressive force upon peep housing 17 is nearly equal at each notch 21. Also shown is one of the frusto conical recesses 23. Frusto conical recess 23 has a 45° taper to reduce incidental light reflection from interfering with the sharpness of the observed target.

Figure 2:
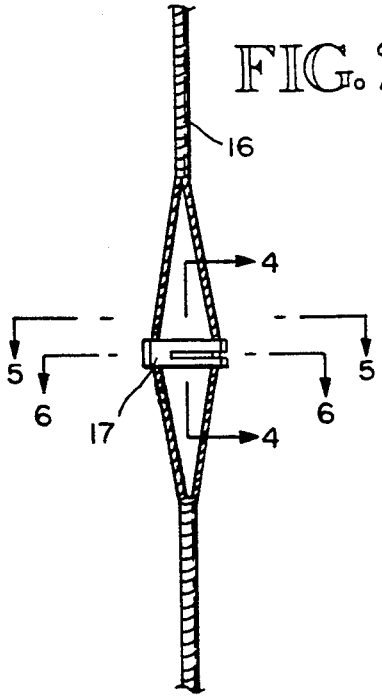
FIG. 2 is a side elevation view of a preferred embodiment of the invention taken substantially along the line 2—2 of FIG. 1.

As best shown in FIG. 2, peep housing 17 is located such that the axis of peep hole 18 is parallel to bowstring 16 when bow 9 is in its resting state. This configuration advantageously permits peep hole 18 to become visible to the archer upon drawing bowstring 16 rearward (See FIG. 3). Also shown in FIG. 2 is receiving slot 22. As will be discussed in more detail below, receiving slot 22 permits various aperture reducing discs 19 to be conveniently inserted and removed from peep housing 17.

Figure 4:
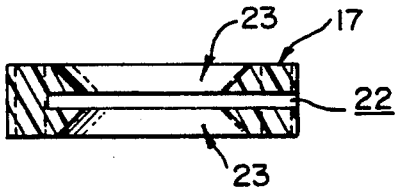
FIG. 4 is a cross sectional view in 2.5:1 scale taken substantially along the line 4—4 of FIG. 2 showing a 45° conical taper about the peep hole.

Turning now to FIG. 4, peep housing 17 is shown in cross section wherein a 45° conical taper to peep hole 18 can be seen.

Figure 5:
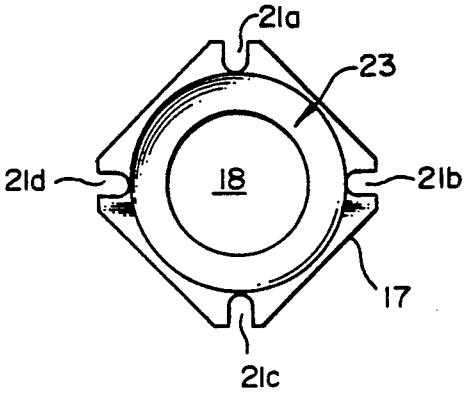
FIG. 5 is a plan view in 2:1 scale taken substantially along line 5—5 of FIG. 2.

FIG. 5 shows the relative characteristics of peep housing 17. Peep hole 18, having a diameter of approximately 0.625 inches, is unusually large for peep housing 17. However, as it will be shown, the aperture of peep hole 18, can be adjusted by inserting aperture reducing discs 19. Also shown in the relative characteristics of notches 21.

Figure 6:
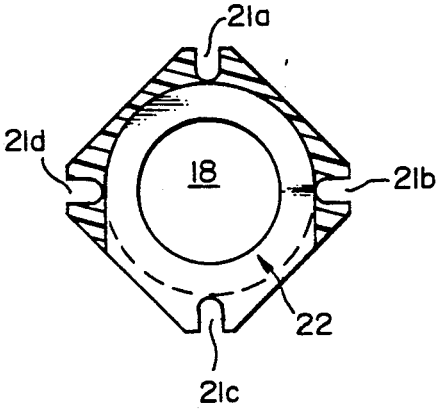
FIG. 6 is a cross sectional view in 2:1 scale taken substantially along the line 6—6 of FIG. 2.
Figure 7:
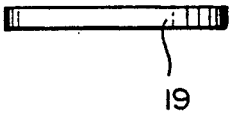
FIG. 7 is an enlarged side elevation view of an aperture reducing disc.
Figure 8:
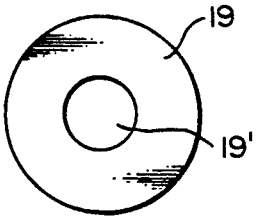
FIG. 8 is an enlarged plan view of the aperture reducing disc.

Turning now to FIG. 6, a cross section of peep housing 17 is shown. Receiving slot 22 is defined by two internally facing and parallel planar surfaces, a semicircular end, and an open end extending tangentially from the terminal points of the semicircular section. Thus, any aperture reducing disc 19 (see FIG. 8) can be inserted at notches 21*c* and slidably moved until the peripheral portion of aperture reducing disc 19 abuts the semicircular portion of receiving slot 22. By inserting various aperture reducing discs 19, each having different internal aperture diameters 19', an archer can vary the effective aperture of peep hole 18. For example, when bow 9 is at full draw, lighting conditions may not be adequate to see the target clearly if a small aperture diameter 19' is used; or aperture diameter 19' may be too large for the given lighting conditions which can cause an inconsistent shooting performance. If the latter situation is true, the archer can insert an appropriate aperture reducing disc 19 into slot 22, thereby causing effective aperture of peep hole 18 to decrease sufficiently. The range of aperture diameters 19' that are possible begin from the maximum diameter of peep hole 18 of peep housing 17 and end at the most minimal desired by the archer.

As also shown in FIG. 6, when receiving bowstring filament 20*c* is located in notch 21*c* aperture reducing disc 19 is prevented from becoming dislodged therefrom. Should it become necessary to remove aperture reducing disc 19, bowstring filament 20*c* may be disengaged from notch 21*c* thereby permitting aperture reducing disc 19 to be slidably removed. An archer may then slidably insert another aperture reducing disc 19 with a larger or smaller aperture diameter 19'. To facilitate the removal of aperture reducing disc 19, an extending portion (not shown) may be formed thereon so as to extend between either notches 21*c* and 21*d*, or notches 21*c* and 21*b* when inserted, to permit an archer to grasp more easily an aperture reducing disc 19.

Returning to FIG. 3, filaments 20*a* through 20*d* each impart a compressive radially inward force from their respective notches 21*a* through 21*d*. The major component of this force is directed upon peep hole 18 which is advantageously circular, thereby providing the most uniform distribution of these compressive forces. Because this configuration provides the most efficient distribution of forces, it permits peep housing 17 to be manufactured from lightweight materials such as plastics or light metals. The inventor has successfully used lightweight, synthetic thermoplastics for all components of the invention.

It is understood that the foregoing represents the preferred embodiment for carrying out the invention and that variations and modifications thereto can be made without departing from the scope and spirit of the patent.

We claim:

1. An adjustable aperture peep sight for mounting between filaments of an archery bowstring comprising:

a peep housing generally having two substantially planar exterior surfaces and a peripheral surface, said housing defining a peep hole having a central axis generally perpendicular to said exterior surfaces and defining a receiving slot, said slot inwardly depending from said peripheral surface of said housing to define an orifice and bounded by said housing, said housing further defining a plurality of bowstring filament receiving notches located at said peripheral surface whereby a corresponding number of filaments of a bowstring may be located therein when mounting said peep housing; and an aperture reducing disc, said disc being slidably receivable in said receiving slot in a direction substantially perpendicular to said axis of said hole, wherein at least one of said plurality of bowstring receiving notches is located at said orifice of said receiving slot to prevent ingress of egress of said aperture reducing disc when a bowstring filament is located therein.

2. The peep sight of claim 1 wherein said notches have a major and minor axis.

3. The peep sight of claim 2 wherein said major axis of said notches is substantially parallel to said axis of said hole.

4. The peep sight of claim 1 wherein at least one recess is formed in said housing, said recess being symmetrical about the axis of said peep hole.

5. The peep sight of claim 4 wherein said at least one recess is characterized as frusto conical.

6. The peep sight of claim 1 wherein said housing is formed from plastic.

* * * * *